US006049316A

United States Patent [19]

Nolan et al.

[11] Patent Number: 6,049,316

[45] Date of Patent: Apr. 11, 2000

[54] PC WITH MULTIPLE VIDEO-DISPLAY REFRESH-RATE CONFIGURATIONS USING ACTIVE AND DEFAULT REGISTERS

[75] Inventors: Rebecca Nolan, Scotts Valley; Richard X. Tang, San Jose, both of Calif.

[73] Assignee: NeoMagic Corp., Santa Clara, Calif.

[21] Appl. No.: 08/874,092

[22] Filed: Jun. 12, 1997

[51] Int. Cl.[7] ..... G09G 5/00

[52] U.S. Cl. ..... 345/1; 345/132

[58] Field of Search ..... 345/132, 213, 345/428, 1, 3; 340/717; 395/162

[56] References Cited

U.S. PATENT DOCUMENTS

| | | | |
|---|---|---|---|
| 5,138,305 | 8/1992 | Tomiyasu | 340/17 |
| 5,375,210 | 12/1994 | Monnes et al. | 395/275 |
| 5,389,952 | 2/1995 | Kikinis | 345/212 |
| 5,404,438 | 4/1995 | Kennedy et al. | 395/154 |
| 5,406,308 | 4/1995 | Shiki | 345/127 |
| 5,432,900 | 7/1995 | Rhodes et al. | 395/154 |
| 5,481,754 | 1/1996 | Piazza | 395/823 |
| 5,488,385 | 1/1996 | Singhal et al. | 345/3 |
| 5,495,263 | 2/1996 | Dalton et al. | 345/3 |
| 5,502,808 | 3/1996 | Goddard et al. | 395/162 |
| 5,517,646 | 5/1996 | Piccirillo et al. | 395/700 |
| 5,596,767 | 1/1997 | Guttag et al. | 395/800 |
| 5,648,795 | 7/1997 | Vouri et al. | 345/132 |
| 5,764,201 | 6/1998 | Ranganathan | 345/3 |
| 5,841,418 | 11/1998 | Bril et al. | 345/3 |

OTHER PUBLICATIONS

"Full Resolution Ahead", Second Looks, PC Magazine Feb. 4, 1997, p. 81.

VESA Display Data Channel Standard, ver. 2 rev 0, Video Electronic Standards Association, Apr. 9, 1996.

*Primary Examiner*—Amare Mengistu
*Assistant Examiner*—Vanel Frenel
*Attorney, Agent, or Firm*—Stuart T. Auvinen

[57] ABSTRACT

A portable personal computer (PC) can be connected to a variety of different external CRT monitors. Configuration of each CRT monitor is performed by the graphics display driver software so that the user does not have to re-configure the graphics sub-system every time a different CRT monitor is connected. Auto-configuration of Plug-and-Play monitors occurs by reading configuration information from the monitor itself. For Windows 95, the Plug-and-Play drivers are used for auto-configuration, or for older operating systems the video BIOS display-data-channel functions is used. Older "legacy" CRT monitors that do not support Plug-and-Play are still auto-configured. The vertical refresh rate for each resolution is stored in a default register on the graphics controller chip. The vertical refresh rate from default register is copied to an active refresh-rate register when a legacy (non Plug-and-Play) monitor is detected. When a Plug-and-Play monitor is detected, the refresh rate is calculated and written to the active refresh-rate register, without overwriting the default registers. Thus a Plug-and-Play monitor can be connected without losing configuration information for the legacy monitors. A Plug-and-Play flag is also added to the graphics controller chip to disable the video BIOS auto-configuration when Windows 95 is used.

18 Claims, 9 Drawing Sheets

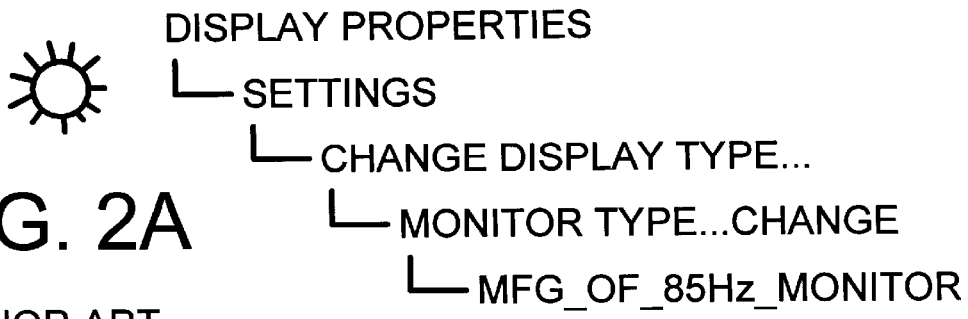
FIG. 2A
PRIOR ART
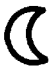
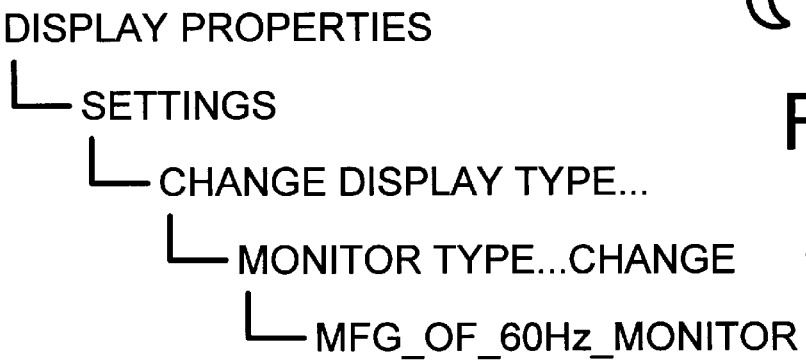
FIG. 2B
PRIOR ART
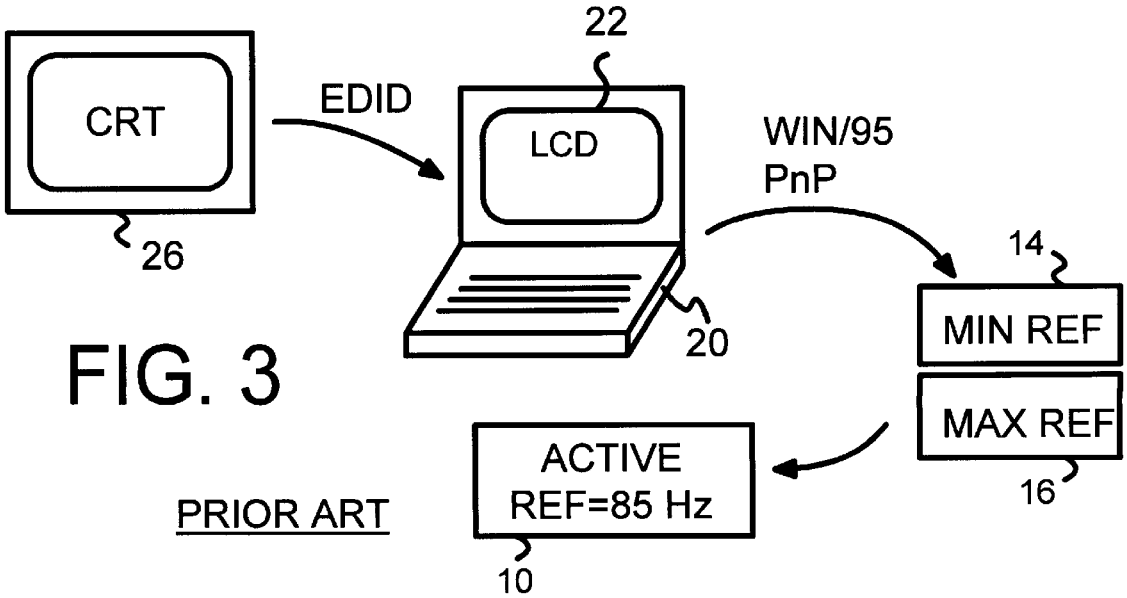
FIG. 3
PRIOR ART

WIN/95 REGISTRY

KEY: CURRENT_CONFIG/DISPLAY/SETTINGS

VGAREF = 75

SVGAREF = 70

XGAREF = 60

RESOLUTION = 800,600

FIG. 7A

WIN 3.1 SYSTEM.INI

VGAREF = 75

SVGAREF = 70

XGAREF = 60

BESTFIT = 1

RESOLUTION = 800,600

FIG. 7B

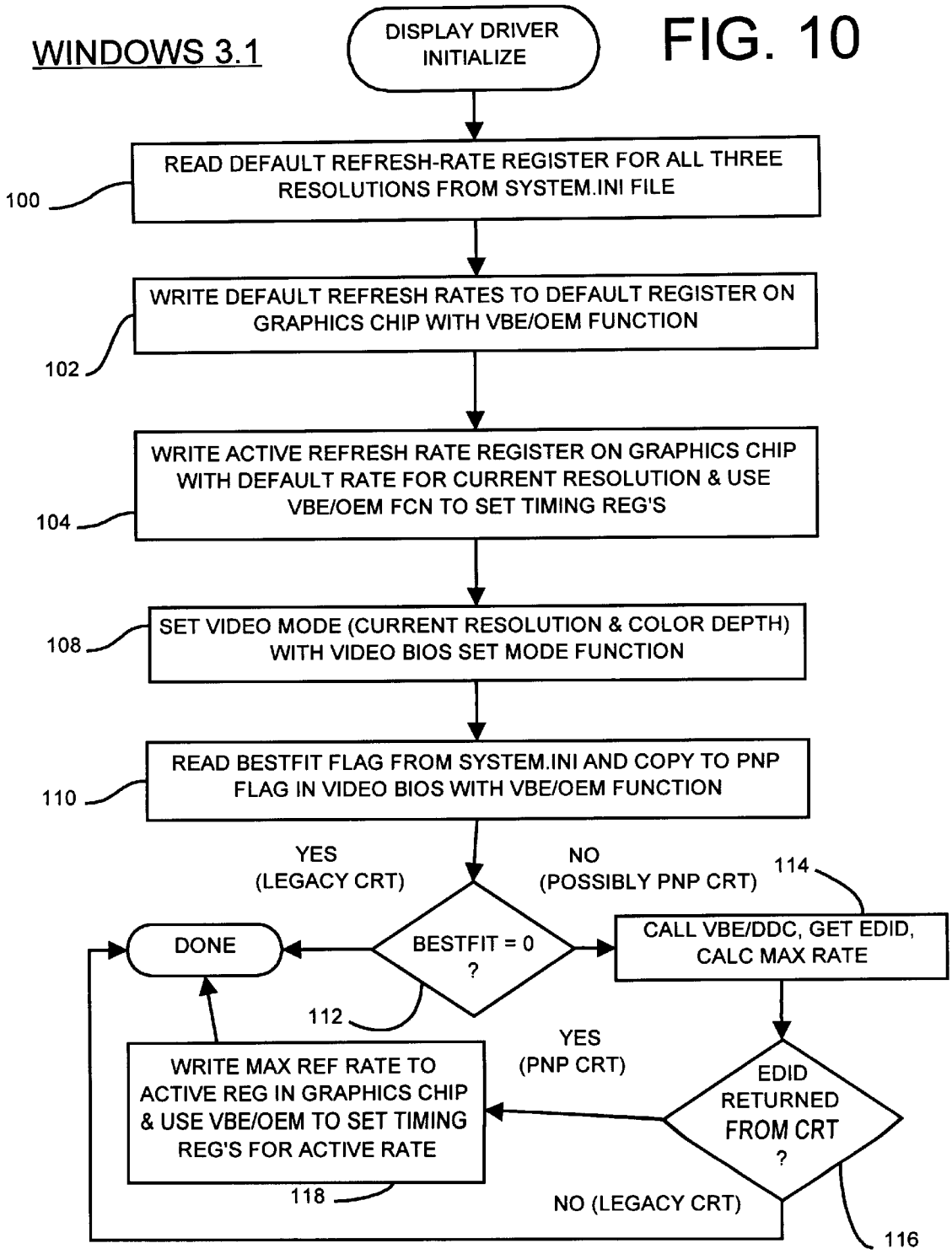
WINDOWS 3.1
DISPLAY DRIVER INITIALIZE
FIG. 10
READ DEFAULT REFRESH-RATE REGISTER FOR ALL THREE RESOLUTIONS FROM SYSTEM.INI FILE
100
WRITE DEFAULT REFRESH RATES TO DEFAULT REGISTER ON GRAPHICS CHIP WITH VBE/OEM FUNCTION
102
WRITE ACTIVE REFRESH RATE REGISTER ON GRAPHICS CHIP WITH DEFAULT RATE FOR CURRENT RESOLUTION & USE VBE/OEM FCN TO SET TIMING REG'S
104
SET VIDEO MODE (CURRENT RESOLUTION & COLOR DEPTH) WITH VIDEO BIOS SET MODE FUNCTION
108
READ BESTFIT FLAG FROM SYSTEM.INI AND COPY TO PNP FLAG IN VIDEO BIOS WITH VBE/OEM FUNCTION
110
YES (LEGACY CRT)
NO (POSSIBLY PNP CRT)
114
DONE
BESTFIT = 0 ?
CALL VBE/DDC, GET EDID, CALC MAX RATE
112
YES (PNP CRT)
WRITE MAX REF RATE TO ACTIVE REG IN GRAPHICS CHIP & USE VBE/OEM TO SET TIMING REG'S FOR ACTIVE RATE
EDID RETURNED FROM CRT ?
118
NO (LEGACY CRT)
116

PC WITH MULTIPLE VIDEO-DISPLAY REFRESH-RATE CONFIGURATIONS USING ACTIVE AND DEFAULT REGISTERS

BACKGROUND OF THE INVENTION—FIELD OF THE INVENTION

This invention relates to control of computer graphics sub-systems, and more particularly to management of multiple configurations for displays on a portable PC.

BACKGROUND OF THE INVENTION—DESCRIPTION OF THE RELATED ART

Today's busy professional worker is constantly on the move—to the office, to the airport, to the train, bus, carpool to get to the office or to get back home again. Increasing workloads and long commute times have given the busy professional worker ample reason to take the work along, trying to catch up during otherwise lost commute time. Technology has come to the rescue, offering powerful yet inexpensive portable computers such as notebook, laptop, or hand-held personal computers (PC's).

Laptop PC's have reached cost and performance levels which allow them to be used in the office as the primary PC on the worker's desk, yet still be taken along on business trips or on the commute home. Some shortcomings of the laptop PC are overcome by expansion ports which allow external keyboards and cathode-ray-tube (CRT) monitors to be attached to the laptop PC. Thus the worker can plug his laptop PC into a high-resolution CRT monitor while at the office, yet still use the laptop on the road or at home. Often at home an older CRT monitor is plugged in to the laptop. On business trips another monitor is sometimes connected while the worker is visiting a satellite office.

Connecting the laptop PC to so many different display monitors create configuration problems. For example, the office CRT is often a newer, expensive high-resolution monitor, while the monitor at home or at a satellite office is more likely to be an older, lower-resolution legacy monitor. The newer monitors support higher refresh rates which reduce flicker, while older monitors must be refreshed at slower rate to avoid damage.

MULTIPLE MONITORS USED IN A SINGLE WORKDAY

FIG. 1 illustrates a portable PC being connected to different displays during a busy day where work is done at the office, on the commute home, and at a home office. Portable PC 20 has a built-in flat-panel display 22 which is constructed from liquid-crystal display (LCD), active matrix, or another display technology. At the worker's office, portable PC 20 is connected to high-resolution CRT 26 through a cable connected to a CRT expansion port or connector on portable PC 20. High-resolution CRT 26 supports a variety of horizontal and vertical clock rates, but higher vertical refresh rates are desired because screen distortions such as flicker are reduced.

While CRT 26 could be operated at a 60 Hz refresh rate, it is desirable to operate it at a higher rate of 85 Hz to reduce flicker and thus eye strain. The refresh rate used may depend on the current resolution selected. Even when lower resolutions are used, the higher refresh rate is desirable. Higher-resolution monitors typically have a higher refresh rate, even when operating at lower resolutions, because the circuitry in the monitor must be able to operate at the higher data rates of the higher resolutions.

Portable PC 20 has configuration registers to control the vertical and horizontal timings generated to CRT 26. In particular, the active refresh rate 10 is set with the vertical refresh rate of 85 Hz so that CRT 26 is refreshed or redrawn 85 times each second.

At the end of the day at the office, portable PC 20 is unplugged from CRT 26 and taken along by the worker. During the commute home, the worker can use portable PC 20 by viewing flat-panel display 22 built in to portable PC 20. The worker may have to re-enable flat-panel display 22 by pressing a hot-key combination to switch the display being driven. The refresh rate may have to be altered to meet the requirements of flat-panel display 22. Typically the hot-key combination calls a BIOS routine to change the display configuration to meet the panel's requirements.

Later that night the worker continues to work at a home office. While the company can afford the expense of high-refresh-rate, high-resolution CRT 26, the worker cannot justify such a high-priced monitor. Instead, the worker's older CRT 24 is connected to portable PC 20. A hot-key combination is pressed to disable flat-panel display 22 and enable driving signals to the CRT port of portable PC 20. However, the vertical refresh rate of 85 Hz is too high for older CRT 24, and active refresh rate 10 must be reprogrammed for the lower refresh rate of 60 Hz of older CRT 24. The worker must first go through the operating system's control panel or another utility to change active refresh rate 10. The resolution may also need to be adjusted downward using the control panel or utility, perhaps from 800×600 SVGA to 640×480 VGA.

Each time the user connects a different CRT monitor, portable PC 20 must be re-configured for the different monitor type. The new monitor's configuration over-writes the old monitor's configuration, and active refresh rate 10 is over-written on each display switch. Even when the same two monitors are connected each day, the process of re-configuring for one monitor and over-writing the configuration of the other monitor is repeated.

TEDIOUS CONFIGURATION OF NEW MONITOR

FIGS. 2A, 2B show how the vertical refresh rate is changed using the Windows 95 operating system of Microsoft Corporation of Redmond, Wash. Upon returning to the office the next day, the worker first changes the display type to that for high-resolution CRT 26. Using the control panel or a desktop utility the worker selects the display properties tool, then selects the settings tab. He clicks with the mouse on "Change Display Type . . . " which brings up another window where "monitor type . . . change" is selected. Finally the worker selects the brand name and model of high-resolution CRT 26, "Mfg_of_85_Hz_Monitor". Windows 95 reads the monitor configuration information from a configuration file. The higher refresh rate of 85 Hz is placed in the Windows/95 registry as the maximum refresh rate. The user can then change the resolution to SVGA or VGA using the settings-desktop area selection of the display properties utility, and press the hot-key combination to disable the flat-panel display and enable driving the external CRT. The display driver reads the maximum refresh rate from the registry and sets the refresh rate when the new video mode is set as the CRT is being enabled.

Upon returning home and connecting older CRT 24, our worker must re-configure portable PC 20 for the older CRT's refresh rate. FIG. 2B highlights the reconfiguration for the older CRT. Again using the control panel or the desktop utility the worker selects the display properties tool, then selects the settings tab. He clicks with the mouse on "Change Display Type . . . " then "monitor type . . . change". Finally the worker selects the brand name and model of older CRT 24, "Mfg_of_60_Hz_Monitor". Windows 95 reads the monitor configuration information from another configuration file. The lower refresh rate of 60 Hz is placed in the Windows/95 registry as the maximum refresh rate, over-writing the earlier value of 85 Hz. The user can then change the resolution from SVGA to VGA using the settings-desktop area selection of the display properties utility, and press the hot-key combination to disable the flat-panel display and enable driving the external CRT. The display driver reads the new maximum refresh rate of 60 Hz from the registry and sets the refresh rate when the new video mode is set as the CRT is being enabled.

This is a somewhat tedious process that must be repeated each time a different external CRT is plugged into the portable PC. Many PC users find such re-configurations confusing. Selecting the wrong configuration can even cause damage to the CRT, such as when the higher refresh rate of 85 Hz is left configured when the older CRT is connected. The 85 Hz signals can damage the 60 Hz circuitry of the older CRT.

PLUG-AND-PLAY EASES SETUP, BUT ONLY FOR NEWER MONITORS

More recently CRT monitors have been constructed using the Plug-and-Play (PnP) standard, which allows the PC to automatically configure the PC for different monitors. FIG. 3 is a diagram of automatic configuration of an external monitor using plug-and-play. High-resolution CRT 26 is a newer monitor capable of supporting plug-and-play, and portable PC 20 also has plug-and-play hardware and software. On system initialization, portable PC sends out a series of clock signals on the 15-pin VGA cable to CRT 26, and CRT 26 responds by transmitting back to portable PC 20 a 128-byte data structure called the extended display identification data (EDID). The EDID contains information about the configurations and refresh rates supported by CRT 26, as defined by the Video Electronics Standards Association (VESA) of San Jose, Calif. in the "Display Data Channel Standard", 1996.

Software in portable PC 20 reads the configuration information in the 128-byte EDID and calculates the minimum and maximum vertical refresh rates 14, 16. From rates 14, 16 and the current resolution desired by the user, and the capabilities of the graphics controller hardware, the active refresh rate can be calculated or selected by the display driver using the appropriate video BIOS function. Thus the correct refresh rate is programmed to be active when both portable PC 20 and CRT 26 have hardware and/or software to support auto-configuration of monitors using plug-and-play.

LEGACY CRT'S REQUIRE MANUAL CONFIGURATION

Unfortunately, plug-and-play is a relatively recent standard and many older CRT monitors do not support the standard. Thus older CRT's such as the worker's home-office CRT 24 cannot be automatically configured. The user must still go through the menus in the Windows control panel to manually reset the monitor type. These legacy monitors are more likely to be encountered by a mobile worker since permanent workers tend to take the newer equipment, leaving the older monitors for visitors with portable PC's.

What is desired is a portable PC which can connect to older as well as newer CRT monitors without forcing the user to manually re-configure the display settings. It is desired to support newer plug-and-play external monitors which can be automatically configured, yet also to support auto-configuration of older legacy monitors. A portable computer is desired which can be connected to a variety of monitors at different times, yet be quickly and automatically configured for each monitor. It is further desired to be able to switch resolutions and change refresh rates with minimal effort by the user.

SUMMARY OF THE INVENTION

A graphics controller sub-system has an active register that stores a current vertical refresh rate. A vertical synchronization timer generates a vertical synchronization pulse with a period corresponding to the current vertical refresh rate stored in the active register. A driving means is coupled to the vertical synchronization timer. It drives the vertical synchronization pulse to an external cathode-ray-tube (CRT) monitor. The vertical synchronization pulse resets the external CRT from a last line of pixels to a first line of pixels.

A default register stores a default vertical refresh rate. The default register is not coupled to the vertical synchronization timer. Host interface means is coupled to the active register and is coupled to the default register. It receives commands from a program executing on a host processor to write a refresh rate to the active register or to the default register. The host interface means writes the refresh rate to the active register or to the default register.

Thus, a default refresh rate and an active refresh rate are stored in the graphics controller sub-system.

In further aspects of the invention the default register is a plurality of registers, each for storing a default vertical refresh rate for a different resolution with a different number of pixels per line and lines of display. Thus, default refresh rates for different resolutions are stored in the graphics controller sub-system.

In still further aspects the different resolutions include a VGA resolution with 480 displayable lines of 640 pixels per line, a SVGA resolution with 600 displayable lines of 800 pixels per line, and an XGA resolution with 768 displayable lines of 1024 pixels per line. Thus, default refresh rates for VGA, SVGA, and XGA resolutions are stored in the graphics controller sub-system.

In further aspects, the graphics controller sub-system has a video memory that stores pixels for display by the external CRT monitor. The video memory is coupled to receive pixels from the host interface means. A pixel transfer means is coupled to the video memory and transfers lines of pixels to the external CRT monitor.

In still further aspects of the invention, the active register and the default register are hardware registers on a graphics controller chip that contains the pixel transfer means.

BRIEF DESCRIPTION OF THE DRAWINGS

FIGS. 2A, 2B show how the vertical refresh rate is changed using the Windows 95 operating system of Microsoft Corporation.

FIG. 3 is a diagram of automatic configuration of an external monitor using plug-and-play.

FIG. 7A is a diagram of entries in the system registry of Windows 95 highlighting new entries for the default refresh rates for legacy monitors.

FIG. 7B is a diagram of entries in the system initialization file of Windows 3.1 highlighting new entries for the default refresh rates for legacy monitors.

FIG. 10 is a flowchart of initialization of the graphics display driver for the Windows 3.1 O/S.

DETAILED DESCRIPTION

The present invention relates to an improvement in graphics controllers. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Overview

The inventors have realized that automatic configuration of older CRT monitors can be supported, even when these monitors are not plug-and-play compatible. Default refresh rates for these legacy monitors can be separately stored and programmed as the active refresh rate when the monitor is not plug-and-play compatible. Newer monitors that support auto-configuration by plug-and-play program the active refresh rate using the configuration information from the monitor itself, bypassing the default refresh-rate registers.

The active refresh rate can be programmed in one of two ways:

1. Older CRT's use a configuration stored in default registers.
2. Newer CRT's use plug-and-play to re-calculate the refresh rate.

The two methods are independent of each other, so that newer CRT's do not alter the default refresh-rate registers. Adding these default refresh-rate registers allows the configuration for older monitors to be stored and not overwritten when a newer plug-and-play monitor is installed. The user has to configure a monitor once to write the correct refresh rate to the default registers; later that monitor can be re-connected without the user re-configuring the monitor since the default registers are subsequently used.

Separating the refresh rates for legacy and plug-and-play monitors into the default and active registers prevents plug-and-play software from disturbing the default rates for legacy monitors. The user can dynamically switch monitors without re-configuration of the refresh rates.

SEPARATE DEFAULT REFRESH-RATE REGISTERS FOR LEGACY AND PLUG-AND-PLAY CRT'S

Figure 1:
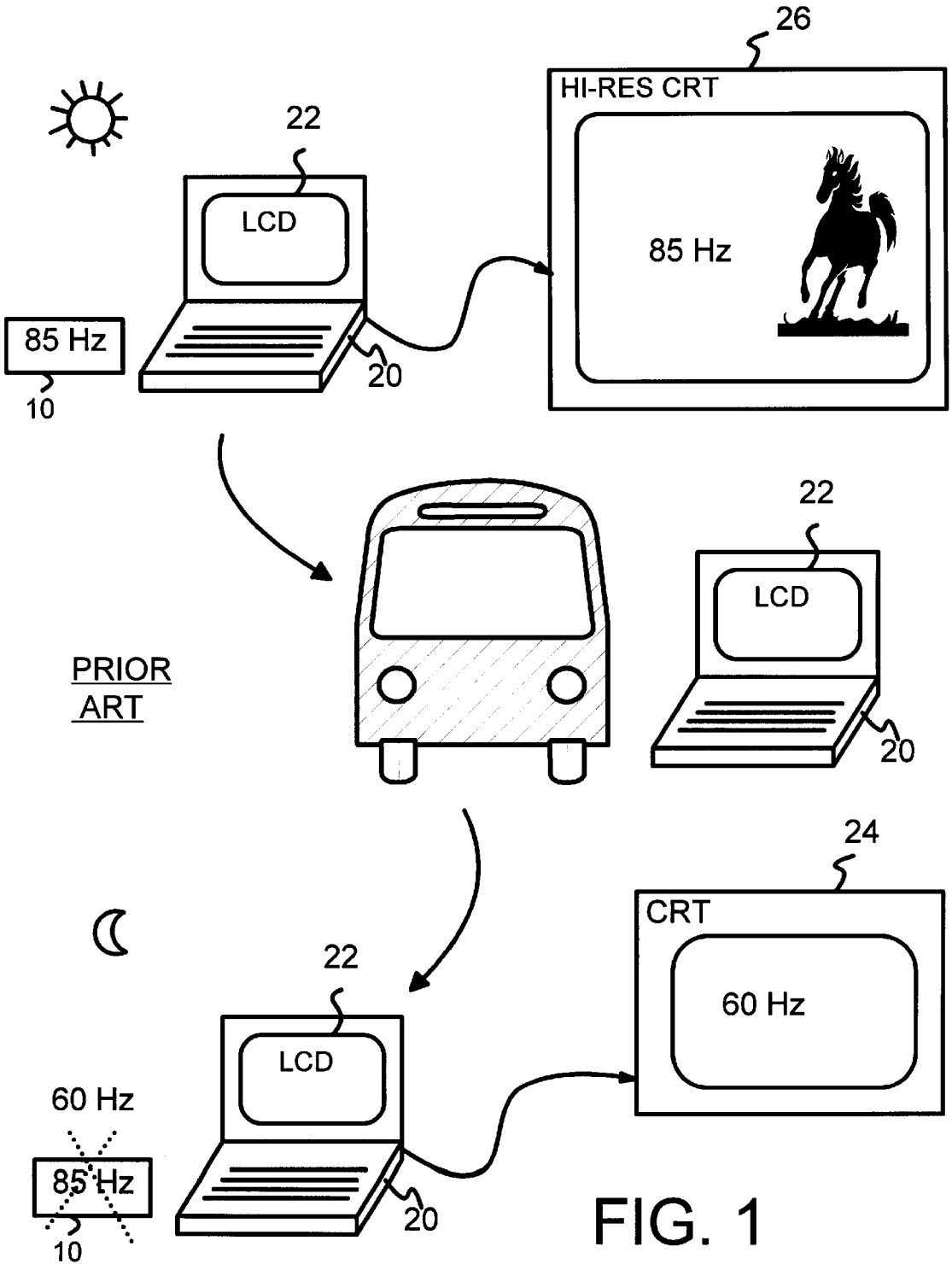
FIG. 1 illustrates a portable PC being connected to different displays during a busy day where work is done at the office, on the commute home, and at a home office.
Figure 4:
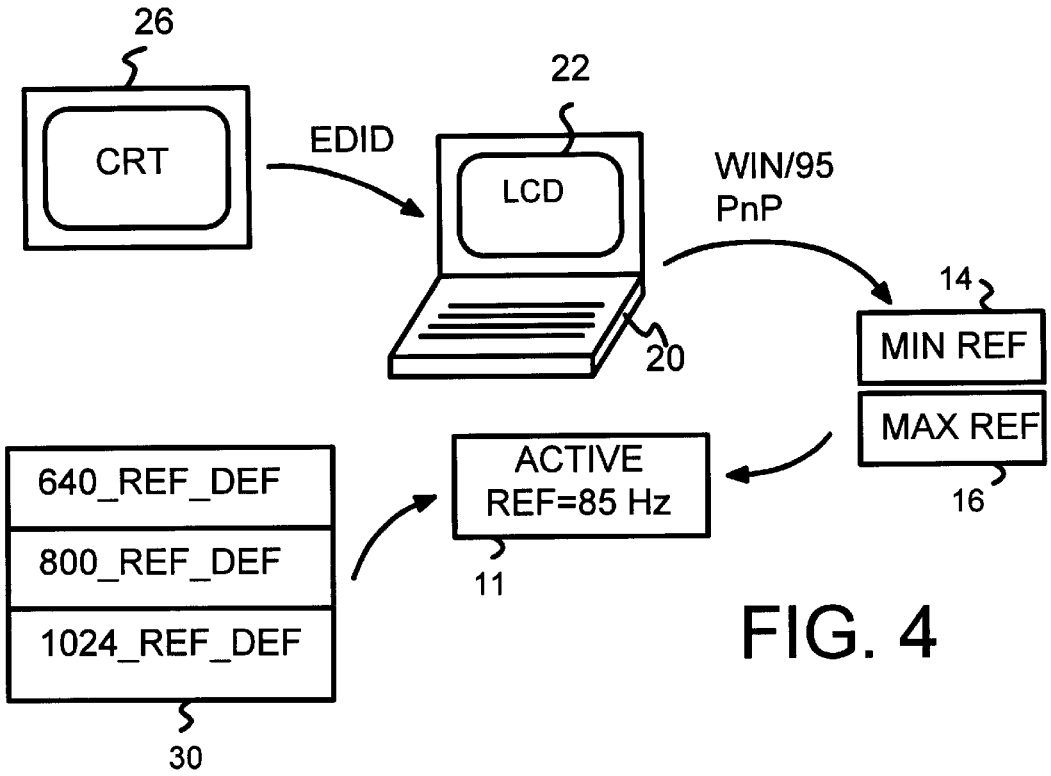
FIG. 4 illustrates auto-configuration of an external CRT monitor using either Plug-and-Play or default refresh-rate registers.

FIG. 4 illustrates auto-configuration of an external CRT monitor using either Plug-and-Play or default refresh-rate registers. When CRT 26 is a newer monitor capable of supporting plug-and-play, and portable PC 20 also has plug-and-play hardware and software, the auto-configuration uses the Plug-and-Play method. On system initialization, portable PC sends out a series of clock signals on the 15-pin VGA cable to CRT 26, and CRT 26 responds by transmitting back to portable PC 20 a 128-byte data structure called the extended display identification data (EDID). The EDID contains information about the configurations and refresh rates supported by CRT 26, as defined by the Video Electronics Standards Association (VESA) of San Jose, Calif.

Software in portable PC 20 reads the configuration information in the 128-byte EDID and calculates the minimum and maximum vertical refresh rates 14, 16. From rates 14, 16 and the current resolution desired by the user, and the capabilities of the graphics controller hardware, the active refresh rate can be calculated or selected and written into active register 11. Thus the correct refresh rate is programmed in the timing registers when both portable PC 20 and CRT 26 have hardware and/or software to support auto-configuration of monitors using plug-and-play.

When CRT 26 is an older "legacy" monitor that is not capable of supporting plug-and-play, then auto-configuration uses default refresh-rate registers 30 rather than the Plug-and-Play method. On system initialization, portable PC first sends out a series of clock signals on the 15-pin VGA cable to CRT 26, but CRT 26 does not responds with the EDID since CRT 26 is not Plug-and-Play compatible. On detecting that no EDID is received, portable PC 20 determines that Plug-and-Play configuration is not possible with the monitor currently attached.

Portable PC 20 then reads default refresh-rate registers 30 to set active register 11 and program the timing registers accordingly. Default refresh-rate registers 30 contain three values, for the three popular resolutions: VGA 640×480, SVGA 800×600, and XGA 1024×768. Portable PC 20 reads the resolution key in the Windows 95 registry, or reads the system. ini file for Windows 3.1, to determine the last resolution set by the user. This resolution is used to select the corresponding refresh-rate parameter from default refresh-rate register 30. The selected parameter for the refresh rate is written to active register 11, setting the active refresh rate to the default value for the current resolution.

Thus the active refresh rate is written into active register 11 either by the Plug-and-Play software, from the minimum and maximum vertical refresh rates 14, 16 calculated from the EDID read from CRT 26, or from default refresh-rate registers 30 for legacy CRT's that do not provide the EDID.

Figure 5:
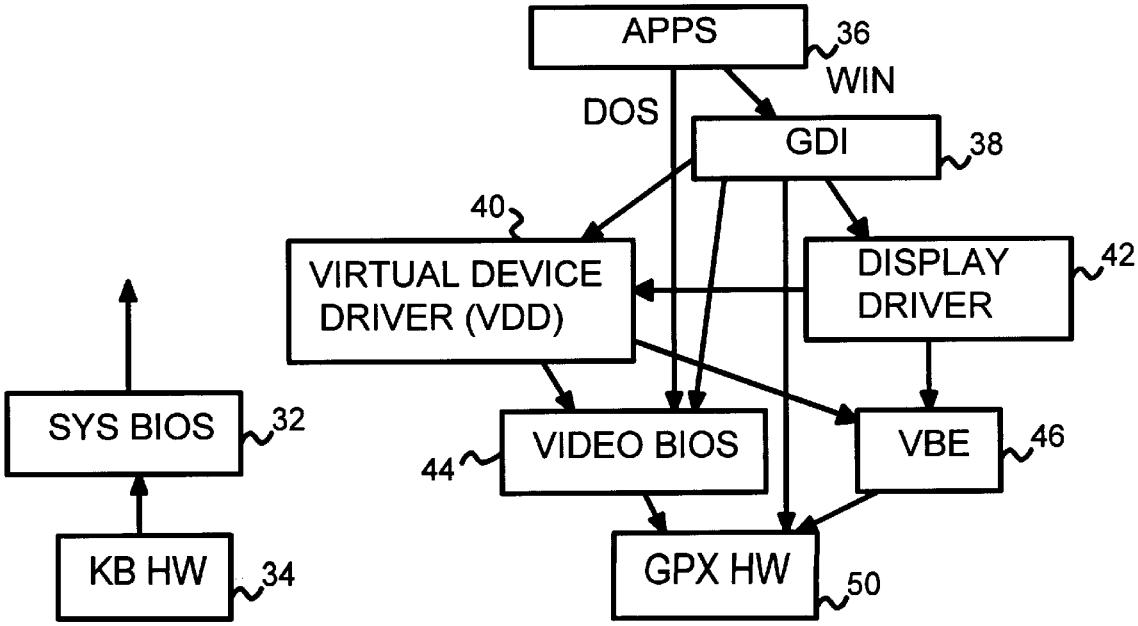
FIG. 5 is a diagram of the hierarchy of software, firmware, and hardware components in a graphics sub-subsystem of a Windows-based portable PC.

Hierarchy of Video Software and Hardware—FIG. 5

FIG. 5 is a diagram of the hierarchy of software, firmware, and hardware components in a graphics sub-subsystem of a Windows-based portable PC. A user can switch from the built-in flat-panel display to an external CRT monitor by pressing a hot-key combination, such as CTL-ALT-Z. This combination varies with each system manufacturer. When the user presses this combination of keys on keyboard hardware 34, the system BIOS (basic input/output system) is notified. The system BIOS then calls video BIOS 44 to change displays.

High-level applications 36 update the display by function calls to the graphics-display interface (GDI) 38, a component of the Windows operating system. GDI 38 write the frame buffer memory directly to update the screen data displayed by graphics hardware 50. Alternately, calls from applications 36 which are older DOS applications that directly wrote to the hardware are intercepted by the Windows virtual device driver VDD) 40 which then calls video BIOS 44. Older DOS programs only run in the DOS-compatibility box.

Graphics display driver 42 is called to update attributes or other parameters in the graphics controller chip. Extension to the video BIOS, VESA BIOS extensions (VBE) 46 are also used to interface display driver 42 to graphics hardware 50. VBE 46 contains extensions to the standard video BIOS 44 written by a hardware manufacturer.

Graphics hardware display driver 42 contains hardware-specific calls and operations and is written by the manufacturer of the graphics controller hardware or chip. Virtual device driver 40 is a part of the Windows operating system and is mainly for DOS compatibility. Windows VDD 40 reads the EDID data from the external CRT by calling a display-data-channel (DDC) routine in VBE 46 which polls the external CRT for the EDID. Windows VDD 40 or another module then calculates the minimum and maximum refresh rates 14, 16 which are then used to determine the active refresh rate.

Figure 6:
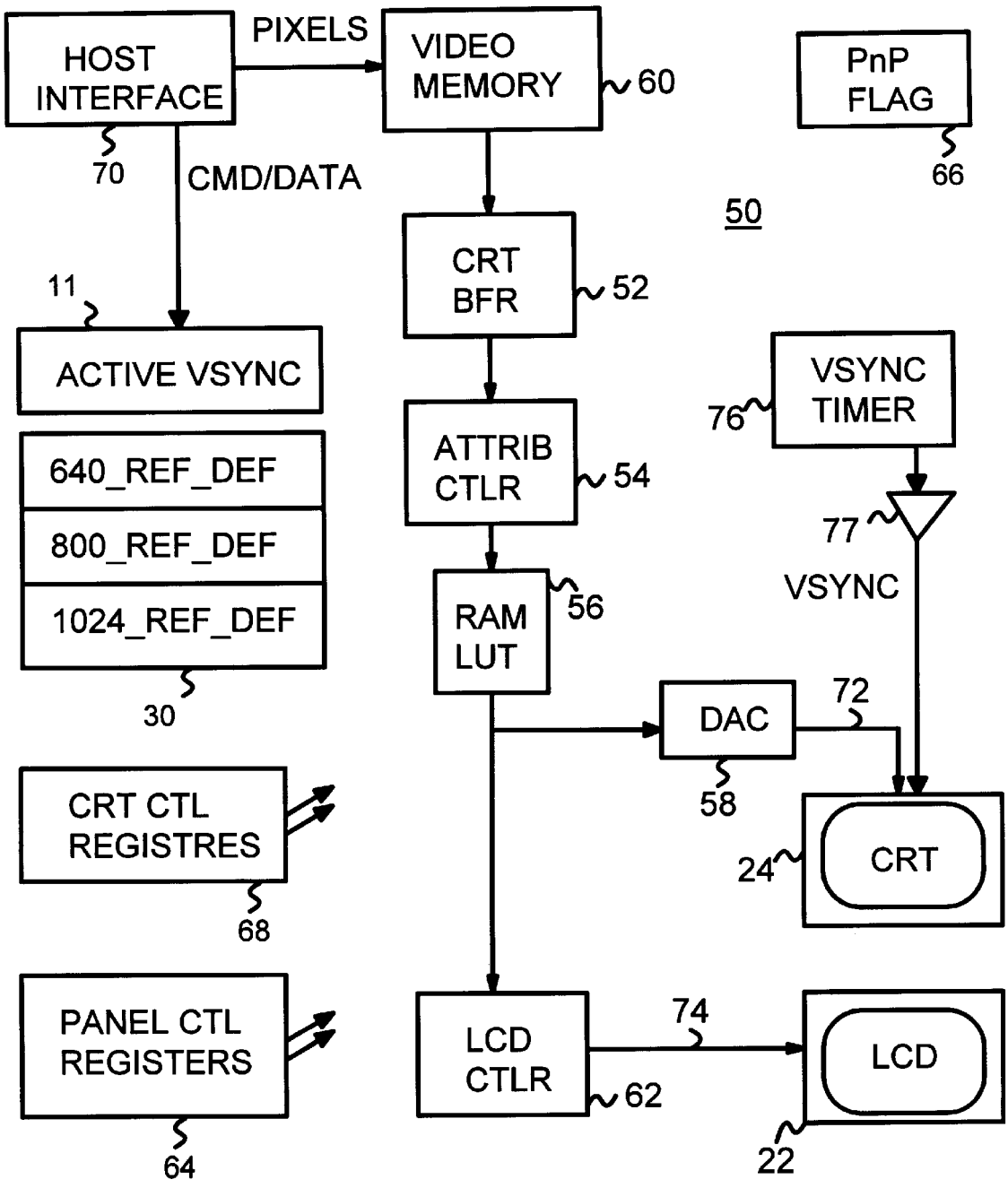
FIG. 6 is a diagram of a graphics controller with active and default registers for setting the vertical refresh rate for an external CRT monitor.

Graphics Controller Hardware with Default and Active Registers—FIG. 6

FIG. 6 is a diagram of a graphics controller with active and default registers for setting the vertical refresh rate for an external CRT monitor. Host interface 70 is coupled to a host bus in the portable PC, such as the PCI bus. Commands and graphics data are received from the PC's main processor over PCI bus by host interface 70. Graphics data, such as pixels for display on the screen, are transferred from host interface 70 to video memory 60 where they are stored.

During a screen refresh, all the pixels displayed on the screen are fetched from video memory 60 and serially transferred to flat-panel display 22 or external CRT 24. The pixels are arranged in horizontal lines as is well-known in the art. CRT buffer 52 is a FIFO buffer which receives pixels from video memory 60 in parallel and transfers them serially to attribute controller 54, which alters attributes to produce effects such as reverse video or blinking. RAM lookup table 56 re-maps the color of the pixels, allowing for a larger virtual palette of colors for a limited number of bits in a pixel. The re-mapped pixels are converted from digital format to analog voltages by digital-to-analog converter (DAC) 58, and the red, green, and blue color components are transmitted to external CRT 24 over external cable 72 as analog voltages. RAM lookup table 56 and DAC 58 are usually integrated together as a RAMDAC.

Re-mapped pixels from RAM lookup table 56 are also transmitted to LCD controller 62, which re-formats the pixels for display on flat-panel display 22, which has a wide digital interface 74. Often the timing of pixels must be altered for transfer to flat-panel display 22. Indeed, the timing and formatting requirements for flat-panel displays differs enough from CRT timing that separate panel control registers 64 are programmed to generate the correct panel timings.

Host interface 70 also receives commands from software such as display drivers executing on the PC's microprocessor. Host interface 70 receives read and write commands and write data and reads or writes internal configuration registers on the graphics controller chip. These configuration registers include CRT control registers 68 which specifies the horizontal and vertical refresh or synchronization rates, and the number of pixels per line. Panel registers 64 contain additional panel-specific configuration data, such as frame clock rate, blanking, and half-frame configurations.

Vertical timing generator 76 generates the vertical synch pulse to external CRT 24. The vertical synch pulse is driven to external CRT 24 through driver 77. The pulse causes external CRT 24 to sweep from the last line of pixels to the first line of pixels displayed for a new frame or screen. Programming different timing values into CRT control registers 68 or panel control registers 68 causes the period of vsync to change, and thus the overall screen refresh rate. Typical values for the refresh rate are 60, 70, 75, and 85 Hz. The actual numerical value programmed into CRT control registers 68 and panel control registers 68 are binary-values representing clock divisors or multipliers, and numbers of pixels per line. These are used by binary counters in vertical timing generator 76 to generate the vsync pulse after the desired period of time. Software tables of video modes and resolutions are used to program the correct binary values into registers 68, 64.

Plug-and-play software calculates the correct refresh rate according to the display's capabilities in the EDID information returned to the PC from the CRT. The graphics controller display driver then encodes the refresh rate and the video BIOS writes the encoded refresh rate into active register 11 using and 10 write cycle on the PC's microprocessor. When plug-and-play software fails to read the EDID polled from the CRT, such as for older legacy CRT's, then the graphics controller display driver reads the current resolution mode, and reads the corresponding value from default refresh-rate registers 30. The default refresh rate for the current resolution is then written to active register 11, and the calculated timing values for CRT register 68 are written, setting the refresh rate for the legacy CRT to the stored default.

Another register written through host interface 70 is Plug-and-Play flag register 66. Plug-and-Play flag register 66 contains a flag which the graphics controller display driver can read to determine when Plug-and-Play should be disabled.

Plug-and-Play flag register 66, active register 11, and default registers 30 reside on the graphics controller chip as scratch-pad registers reserved for use by the video BIOS. In one embodiment, 7 bytes of scratch-pad memory is available for use by the video BIOS.

Adding default refresh-rate registers 30 and Plug-and-Play flag register 66 to the graphics controller allows driver software to quickly update the CRT configuration as different monitors are connected. Storing the default refresh rates on the graphics controller chip prevents other software from overwriting it since I/O cycles rather than memory-space cycles are required for access. Often two or more I/O cycles with specific data values are required to unlock the register. Thus the default rates are more secure than if stored solely as a data structure on the hard disk or in main memory.

Default Refresh Rates Also Stored on Disk—FIGS. 7A, 7B

FIG. 7A is a diagram of entries in the system registry of Windows 95 highlighting new entries for the default refresh rates for legacy monitors. The default refresh rates are primarily stored in a hardware register in the graphics controller chip. However, when power is shut off, these values are lost. Thus the default refresh rates also need to be stored on disk as a backup.

While a separate file could be used for the default values, these default values are preferable stored in the registry of Windows 95 as additional parameter entries. In the current_configuration/display/settings key, the default refresh rates are added as three parameters: VGAREF, SVGAREF, and XGAREF. These three parameters store the default refresh rates for VGA, SVGA, and XGA resolutions. FIG. 7A shows the default refresh rate for VGA is 75 Hz, while the default for SVGA is 70 Hz and for XGA is 60 Hz. Since the current resolution is 800×600, or SVGA, the SVGAREF default rate of 70 Hz is selected and written to the active register when a non Plug-and-Play monitor is connected to the PC and the user reboots or hot-keys for a display switch. The default rates may not match the actual refresh rate, as when a Plug-and-Play monitor has been configured.

These default refresh rates cannot be overwritten by Plug-and-Play software since that software is not aware of these additional parameters. These parameters are known only to the graphics display driver software. The user can set the default refresh rates using the registry editor, or a utility to set these default rates can be written by the graphics controller or PC vendor.

FIG. 7B is a diagram of entries in the system initialization file of Windows 3.1 highlighting new entries for the default refresh rates for legacy monitors. In the NeoMagic_95 section of the system.ini file the default refresh rates are added as three additional parameters: VGAREF, SVGAREF, and XGAREF. These three parameters store the default refresh rates for VGA, SVGA, and XGA resolutions. The default refresh rate set for VGA is 75 Hz, while for SVGA is 70 Hz and for XGA is 60 Hz. Since the current resolution is 800×600, or SVGA, the SVGAREF default rate of 70 Hz is selected and written to the active register when a non Plug-and-Play monitor is connected to the PC.

A BESTFIT parameter is added to the system.ini file to allow for emulation of Plug-and-Play for displays for older operating systems such as Windows 3.1.

Changing Resolution Easier than Changing Refresh Rate

Changing the vertical refresh rate of the monitor is a complex process requiring that several layers of menus be navigated, as shown in FIGS. 2A, 2B. Changing the resolution of the display is simpler as fewer sub-menus need to be navigated. For example, Windows 95 requires 4 levels of menu selections for changing the refresh rate (monitor type), while only 2 levels of menus need to be navigated to change the resolution. The user merely slides the desktop area sliding-lever to increase or decrease the resolution in the display properties—settings sub-menu. For example, when the user wants to increase the resolution from VGA to SVGA without changing the monitor, the user merely slides the desktop area sliding-lever from "640×480" to "800×600", then next higher setting. Thus changing the resolution to display more pixels is a relatively simple task compared to explicitly changing the vertical refresh rate.

When the user change the resolution of a plug-and-play CRT, the invention performs a set video mode function and re-calculates the refresh rate using the plug-and-play method to load the active register. However, when a non-plug-and-play monitor is attached, the default refresh-rate registers are read, and the refresh-rate value for the new resolution is copied to the active register. Thus no calculation is required for legacy monitors since the refresh rates for each resolution are stored in the default registers. Changing the resolution then changes the refresh rate without the additional configuration steps by the user. Having separate default values for each resolution allows the monitor's display to be optimized for the different timing requirements of each resolution and the capabilities of the monitor.

Windows 95 Reads EDID from CRT

Figure 8:
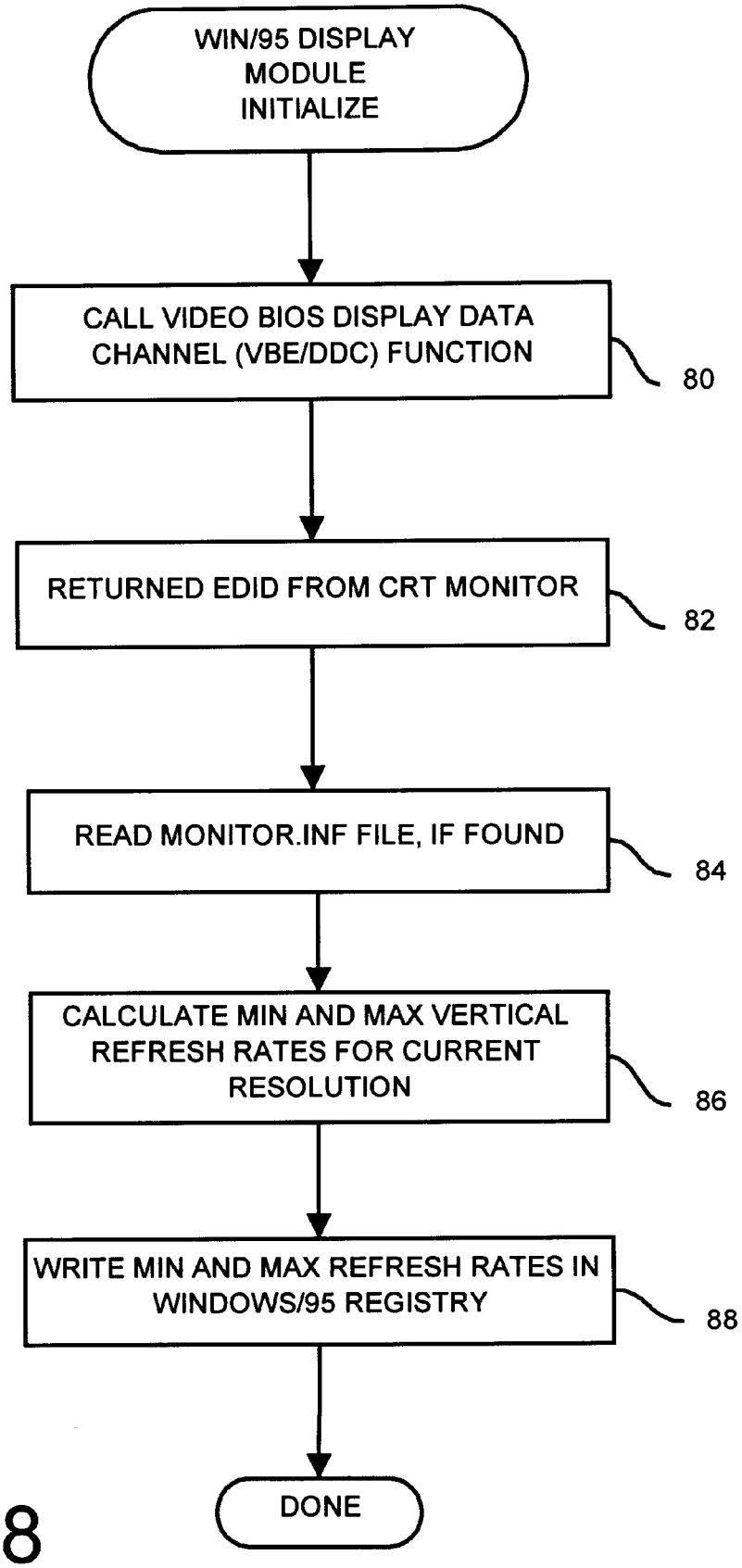
FIG. 8 is a flowchart of initialization of video functions of the Windows 95 O/S when the display is polled to retrieve CRT configuration.

FIG. 8 is a flowchart of initialization of video functions of the Windows 95 O/S when the display is polled to retrieve CRT configuration. The Windows 95 operating system uses a software module to perform Plug-and-Play functions for the display. During booting of a PC, the system BIOS loads the video BIOS and other OS drivers including the module. FIG. 8 focuses on the display Plug-and-Play part of the module.

After the module is loaded into main memory, an initialization is executed. Initialization eventually calls the video BIOS display-data-channel function, step 80. The function is a video BIOS extension known as the VDE/DCC function. This function reads the EDID structure from the CRT and returns the 128-byte EDID into the caller's buffer. This function is called by placing 4F15Hex in the AX x86 register and 01 in the BL register.

The VBE/DDC function returns the EDID structure from the CRT monitor, step 82. The EDID contains manufacturer-specific information about the capabilities of the monitor such as the resolutions and synch rates supported. A .inf file on the hard disk may also be read to obtain configuration information about the external CRT (step 84). The minimum and maximum vertical refresh rates are calculated, step 86, from the EDID and/or .inf file. These vertical refresh rates depend on the current resolution; often lower resolutions can operate at a higher vertical refresh rate since fewer pixels are transferred during each screen refresh.

The minimum and maximum refresh rates are written to the Windows 95 registry, step 88, and the module initialization routine ends.

Graphics Display Driver Initialization

Figure 9:
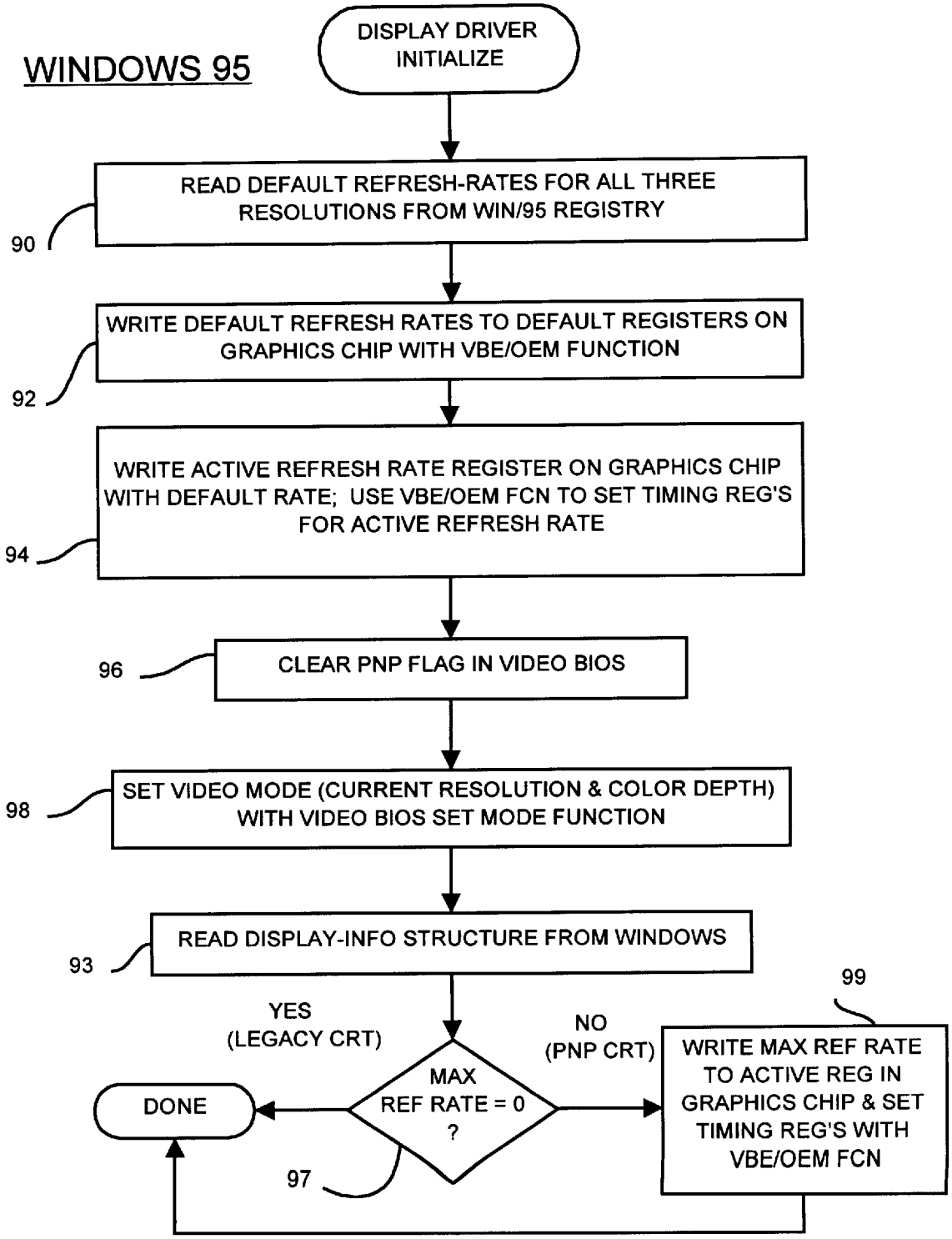
FIG. 9 is a flowchart of initialization of the graphics display driver for the Windows 95 O/S.

The display driver is typically produced by the manufacturer of the graphics chip or card. Different display drivers are used for different operating systems. FIG. 9 is a flowchart of initialization of the graphics display driver for the Windows 95 O/S. The display driver initializes as part of the booting procedure, setting the refresh rate and other parameters to control the graphics controller.

The Windows 95 registry is read, step 90, to retrieve the three default refresh-rate parameters shown in FIG. 7A. These three parameters are not standard parameters in Windows 95 ; they are proprietary parameters used by the graphics display driver. These three default refresh-rate parameters are then written to the default refresh-rate registers on the graphics controller chip, register 30 of FIG. 6 (step 92). The video BIOS extension function VBE/OEM is used. OEM functions are proprietary functions written by the graphics controller manufacturers. These functions are defined as function 4F14Hex, with specific OEM functions being called by setting different data values into the x86 architecture register BL. When BL=10Hex, then the data in the CX register is written to Three such calls are needed to write the three parameters.

The VBE/OEM function is called to also write to the active register (register 11 of FIG. 6) when the current resolution is the same as the resolution of the default register being written. Thus the active refresh-rate register on the graphics controller chip is also written, step 94. The CRT timing registers are also written with timing values which generate the active refresh rate. A video mode table in software is used to determine the timing values that result in the desired active refresh rate.

The Plug-and-Play flag (66 of FIG. 6) of the graphics controller chip is cleared, step 96. The Plug-and-Play flag must be cleared so that the video BIOS does not also perform Plug-and-Play functions using VBE/DDC when Windows 95 also performs Plug-and-Play functions. BL=06Hex calls the Plug-and-Play flag set/clear function.

The video mode is set by calling the set mode function of the video BIOS, step 98. The video mode includes the current resolution (VGA, SVGA, or XGA) and the color depth (bits per pixel). Set Video mode is VBE function 4F02, or VGA function 00. This function writes the active register with the default value for the current resolution.

The Windows function is called to read the DisplayInfo data structure which contains the maximum refresh rate information, step 93. The maximum refresh rate is set to zero when no EDID structure was read, such as for legacy monitors. Step 97 tests for the zero maximum refresh rate and ends initialization when a zero is found. The active refresh rate is left containing the default rate from step 94.

When the maximum refresh rate is non-zero, then the maximum refresh rate is copied to the active refresh-rate register, step 99. However, sometimes the video BIOS or graphics chip cannot support the maximum refresh rate for the CRT. When the maximum rate is not supported, then the nearest available rate below the maximum rate is selected for writing to the active register. The CRT timing registers are also written with timing values that generate the active refresh rate.

Thus the maximum refresh rate calculated from the Plug-and-Play monitor's EDID structure is used for Plug-and-Play monitors, but the default refresh-rate is used for legacy monitors. The active refresh rate is set even when an external monitor is not attached, as when only the portable PC's flat-panel display is on. This allows a user to plug an external CRT into the portable PC when the power is on and perform a display switch using the hot-key combination.

FIG. 10 is a flowchart of initialization of the graphics display driver for the Windows 3.1 O/S. The default refresh rates are read from the system.ini file, step 100. These parameters are shown in FIG. 7B. These three parameters are written to the default register on the graphics controller chip, step 102, using the VBE/OEM function described earlier. The active register is also written for with the default refresh-rate parameter for the current resolution, step 104. The CRT timing registers are also written with timing values that generate the active refresh rate. The video mode table in software is used to determine the timing values that result in the desired active refresh rate. The video mode is set, step 108.

The BESTFIT flag is read from the system.ini file, step 110. The BESTFIT flag is an additional flag put in the system.ini file by the graphics controller driver and is not a standard part of Windows. This flag controls auto-detection of displays even though Windows 3.1 does not directly support Plug-and-Play. The video BIOS VBE/DDC function is similar to Windows 95 Plug-and-Play. This BESTFIT flag is copied to the Plug-and-Play flag register on the graphics controller chip using the VBE/OEM function.

The BESTFIT flag is tested, step 112, and when zero, no auto-detection of the CRT is desired. The active refresh rate is left containing the default rate from step 104.

When BESTFIT is one, auto-detection is enabled. The VBE/DDC function of the video BIOS is called, step 114, which polls the external CRT to retrieve the EDID structure. The maximum and minimum refresh rates are calculated from the EDID. When the external monitor is a legacy monitor, no EDID is returned, and step 116 ends the initialization, leaving the active refresh rate containing the default rate from step 104.

When an EDID is returned, step 116, then the maximum refresh rate is written to the active refresh-rate register on the graphics controller chip, step 118. The VBE/OEM function 4F14Hex, with BL=10Hex, CX=OFFHex, is used. The different values of the refresh rate (60 Hz, 70 Hz, 72 Hz, 75 Hz, 85 Hz) are encoded in the DH register. The CRT timing registers are also written with timing values that generate the active refresh rate.

Thus even for Windows 3.1, which does not support Plug-and-Play, auto-detection of the display can be accomplished by the video BIOS when the BESTFIT flag is set, or disabled when the flag is cleared. Legacy monitors use the default refresh rates regardless of the BESTFIT flag.

Figure 11:
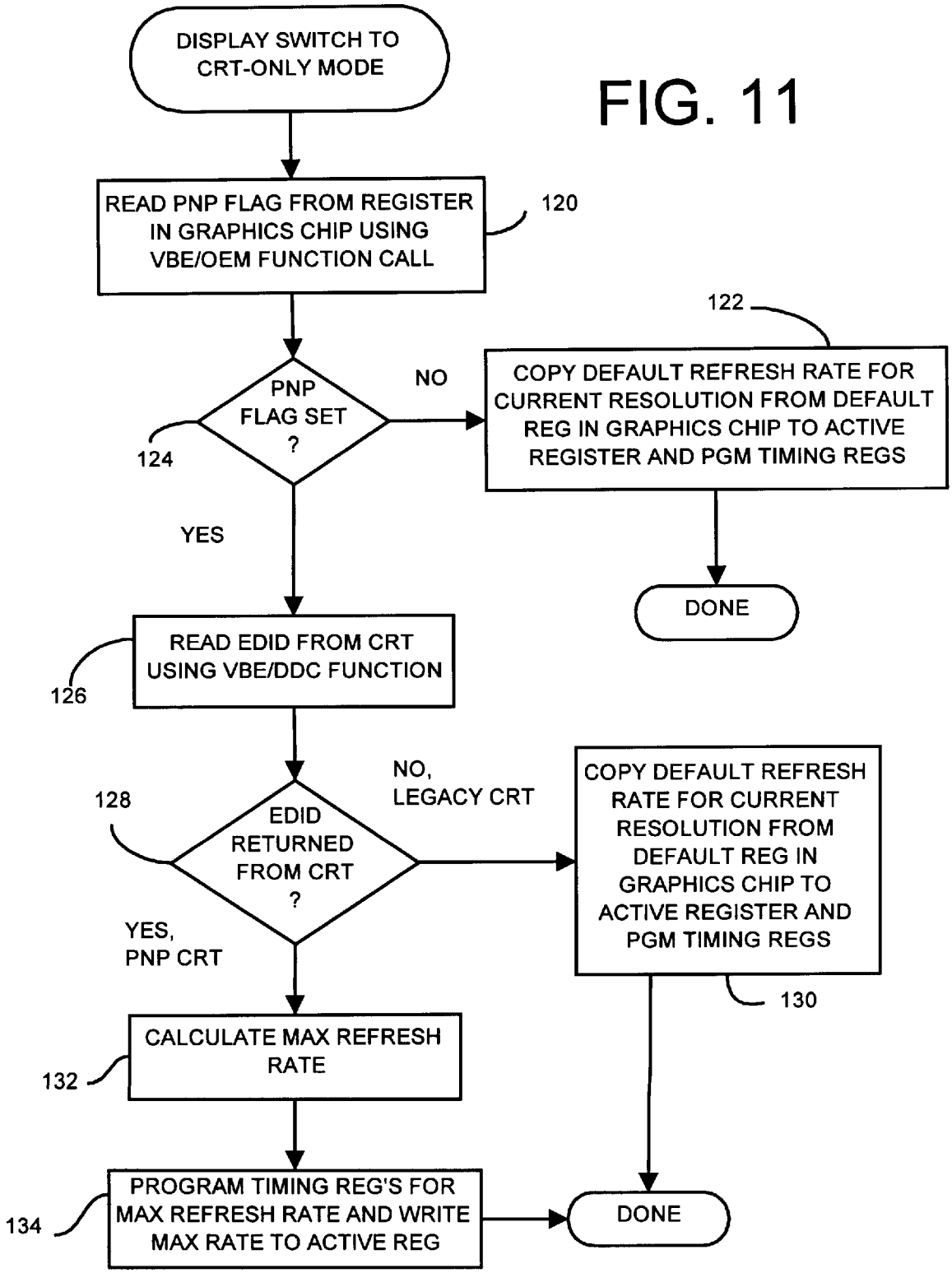
FIG. 11 is a flowchart for the display switch function which uses either Plug-and-Play/DDC to auto-configure the graphics controller, or the default refresh rates.

Display Switch Function—FIG. 11

FIG. 11 is a flowchart for the display switch function which uses either Plug-and-Play/DDC to auto-configure the graphics controller, or the default refresh rates. The procedure of FIG. 11 is used for either Windows 3.1 or Windows 95 when switching to CRT-only display mode.

The display switch function is called when the user manually requests a display switch by pressing a hot-key combination, such as CTL-ALT-Z. The display switch function can also be called when the user selects a new display, or combination of displays, from the Windows control panel or display sheet.

A VBE/OEM function is called. The Plug-and-Play flag register on the graphics controller chip (66 of FIG. 6) is read, step 120. The Plug-and-Play flag is tested, step 124, and if the flag is zero (cleared) then the active refresh rate is set from the default rate, step 122. The timing registers are set to generate the refresh rate in the active register.

When the Plug-and-Play flag is set, the video BIOS rather than Windows 95 performs the display sensing and configuration. The Plug-and-Play flag is cleared for Windows 95 to prevent the video BIOS from using the DDC function to retrieve the EDID, as Windows 95 has already retrieved the EDID using the VDD module during initialization. However, Windows 3.1 does not have its own Plug-and-Play code, so the DDC function in the video BIOS is used instead. The Plug-and-Play flag in the graphics controller chip is used to enable the video BIOS DDC. The Plug-and-Play flag is set to indicate that the video BIOS must use DDC to emulate plug-and-play for Windows 3.1, which does not have Plug-and-Play capability.

The EDID is read from the external CRT, step 126, using the VBE/DDC function in the video BIOS. When the attached CRT is a legacy monitor, no EDID structure is returned. The failure to retrieve the EDID is detected, step 128.

When no EDID is returned, the CRT is an older legacy monitor. The default refresh rate for the current resolution is read from the default refresh-rate register on the graphics controller chip and the video BIOS sets the timing registers on the graphics controller chip to generate the default rate as the active refresh rate, step 130. The video BIOS is called on the next cursor update and writes the active register. Thus the default rate is written to the active rate for legacy monitors.

When an EDID is returned from the external CRT, then the minimum and maximum refresh rates are calculated, step 132. The maximum refresh rate is written to the active register on the graphics controller chip to set the vertical refresh rate to the maximum rate allowed by the monitor's EDID data structure, step 134. The timing registers are set to generate the refresh rate in the active register. The maximum rate may have to be adjusted downward when the graphics controller chip cannot operate at exactly the maximum rate, as when only certain values of refresh rate are supported.

Thus on a display switch, the active rate is set to the default rate for legacy monitors or the rate calculated from the CRT's EDID when a Plug-and-Play CRT is used. When Windows 95 is used, the active rate is not changed, allowing the Plug-and-Play code in Windows 95 to determine the active rate. The default rates are written to the registry by the video drivers during initialization and remain unless changed by a user.

Whenever the control panel or display properties is activated by the user, the display driver or video BIOS is called to read the refresh rate from the active register on the graphics chip. The EDID information may also be re-fetched from the external CRT.

Advantages of the Invention

Separating the refresh rates for legacy and plug-and-play monitors into the default and active registers prevents plug-and-play software from disturbing the default rates for legacy monitors. The user can dynamically switch monitors without reconfiguration of the refresh rates. Having separate default refresh-rate values for each resolution allows the graphics system to be optimized for the different timing requirements of each resolution and the capabilities of the attached monitor.

Adding the default refresh-rate registers and the Plug-and-Play flag register to the graphics controller allows driver software to quickly update the CRT configuration as different monitors are connected. Storing the default refresh rates on the graphics controller chip prevents other software from overwriting it since I/O cycles rather than memory-space cycles are required for access. Often two or more I/O cycles with specific data values are required to unlock the register. Thus the default rates are more secure than if stored solely as a data structure on the hard disk or in main memory.

The video BIOS always has access to the refresh-rate registers, but does not have access to the system memory since the O/S manages the memory. Since the refresh-rate registers are not part of the main system memory, these refresh rates are invisible to the system's O/S, allowing a display switch to be transparent to the O/S.

Alternate Embodiments

Several other embodiments are contemplated by the inventors. For example a single default refresh-rate register could be used for all resolutions, or multiple resolutions could share the same default register. Other resolutions could be supported. The default registers on the graphics controller chip can be located in a small scratch-pad memory. A hardware active register could exist in the scratch memory. Polarities of flags and bits can be inverted. Other OEM's may use different registers other than BL, CX, etc.

While the active register has been used to illustrate the concept of the active refresh rate, in actual practice active register can be conceptual rather than a physical register. The vertical refresh rate is not determined by a single register but is determined by the horizontal line rate and the total number of lines. The selected active refresh rate from the default refresh-rate registers is used to calculate the frequencies of the horizontal clock and/or the pixel clock. The horizontal clock rate divided by the number of lines for the video resolution is the vertical refresh rate generated. The horizontal clock rate itself can be generated by a pixel or dot clock divided by the number of pixels per horizontal line. Thus a vertical refresh-rate register is redundant with other timing registers.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A graphics controller sub-system comprising:

an active register for storing a current vertical refresh rate;

a vertical synchronization timer, for generating a vertical synchronization pulse having a period corresponding to the current vertical refresh rate stored in the active register;

driving means, coupled to the vertical synchronization timer, for driving the vertical synchronization pulse to an external cathode-ray-tube (CRT) monitor, the vertical synchronization pulse for resetting the external CRT from a last line of pixels to a first line of pixels;

a default register for storing a default vertical refresh rate, the default register not coupled to the vertical synchronization timer; and host interface means, coupled to the active register and coupled to the default register, for receiving commands from a program executing on a host processor to write a refresh rate to the active register or to the default register, the host interface means writing the refresh rate to the active register or to the default register;

sensing means, coupled to a cable to the external CRT monitor, the cable for transmitting the vertical synchronization pulse to the external CRT monitor and for transmitting pixels from the pixel transfer means to the external CRT monitor, the sensing means for reading from the external CRT monitor a data structure containing configuration data for the external CRT monitor;

calculation means, coupled to the sensing means, for calculating a maximum vertical refresh rate from the data structure, the calculation means executing on the host processor; and update means, coupled to the calculation means, for writing the maximum vertical refresh rate from the calculation means to the active register when the sensing means reads the data structure from the external CRT monitor, the update means writing the default vertical refresh rate from the default resister to the active register when the sensing means cannot read the data structure from the external CRT monitor, whereby the active register is written with a refresh rate calculated from the data structure from the external CRT monitor or written with the refresh rate from the default register when no data structure is read and whereby a default refresh rate and an active refresh rate are stored in the graphics controller sub-system.

2. The graphics controller sub-system of claim 1 wherein the default register comprises a plurality of registers each for storing a default vertical refresh rate for a different resolution having a different number of pixels per line and lines of display, whereby default refresh rates for different resolutions are stored in the graphics controller sub-system.

3. The graphics controller sub-system of claim 2 wherein the different resolutions include a VGA resolution having 480 displayable lines of 640 pixels per line, a SVGA resolution having 600 displayable lines of 800 pixels per line, and an XGA resolution having 768 displayable lines of 1024 pixels per line, whereby default refresh rates for VGA, SVGA, and XGA resolutions are stored in the graphics controller sub-system.

4. The graphics controller sub-system of claim 1 further comprising:

a video memory for storing pixels for display by the external CRT monitor, the video memory coupled to receive pixels from the host interface means;

pixel transfer means, coupled to the video memory, for transferring lines of pixels to the external CRT monitor.

5. The graphics controller sub-system of claim 4 wherein the active register and the default register are hardware registers on a graphics controller chip containing the pixel transfer means.

6. The graphics controller sub-system of claim 1 further comprising:

an auto-sensing enable flag, coupled to be written by the host interface means, for storing an enable flag for enabling and disabling the sensing means, whereby auto-sensing is disabled by the auto-sensing enable flag.

7. The graphics controller sub-system of claim 6 further comprising:

a panel controller, coupled to the pixel transfer means, for converting pixels to a format for display by an internal flat-panel display, the internal flat-panel display permanently connected to the graphics controller sub-system and the host processor.

8. A method of automatically configuring an external display monitor connected to a personal computer (PC), the method comprising the computer-implemented steps of:

polling an external display monitor connected to the PC for a configuration sequence;

reading the configuration sequence from the external display monitor;

when the external display monitor does not return the configuration sequence:

reading a default refresh rate from a default register;

writing the default refresh rate to an active refresh-rate register on a graphics controller, and writing timing values to timing registers on the graphics controller, the timing values generating a vertical synchronization signal to the external display monitor at a frequency indicated by the active refresh-rate register;

when the external display monitor returns the configuration sequence:

calculating a maximum refresh rate from the configuration sequence;

writing the maximum refresh rate to the active refresh-rate register on the graphics controller, and writing timing values to the timing registers on the graphics controller, the timing values generating the vertical synchronization signal to the external display monitor at a frequency indicated by the active refresh-rate register, and retaining the default refresh rate when the active refresh-rate register is written, wherein the default refresh rate is not over-written during auto-configuration when the active refresh-rate register is written, whereby the graphics controller is automatically configured for the external display monitor using either the configuration sequence or the default refresh rate.

9. The method of claim 8 further comprising the computer-implemented steps of:

initializing the default refresh rate for each resolution of the external display monitor, each resolution having a default refresh rate, selecting the default refresh rate for a current resolution for writing to the active refresh-rate register, whereby default refresh rates are stored for each resolution.

10. The method of claim 9 wherein the step of initializing the default refresh rate comprises reading a Windows system registry for a user-definable parameter specifying the default refresh rate, whereby the default refresh rate is stored in the Windows system registry.

11. The method of claim 10 further comprising:

reading an auto-configuration flag;

when the auto-configuration flag is cleared, not polling the external display monitor connected to the PC for the configuration sequence, whereby the external display is not polled when the auto-configuration flag is cleared.

12. The method of claim 11 wherein the step of reading the default refresh rate from the default register comprises executing a program on a central processing unit on the PC to generate I/O write and read cycles to a graphics controller chip.

13. The method of claim 12 wherein the method is executed when a new external display monitor is connected to the PC.

14. The method of claim 13 wherein the PC is a portable PC having a built-in flat-panel display and a connector for connecting to the external display monitor.

15. The method of claim 14 wherein the configuration sequence is an extended display identification data structure (EDID).

16. A computer-program product comprising:

a computer-usable medium having computer-readable program code means embodied therein for auto-configuring an external CRT, the computer-readable program code means in the computer-program product comprising:

reading means for reading a system registry file for default refresh rates for a plurality of resolutions;

writing means for writing the default refresh rates to a default register on a graphics controller chip;

active-register writing means for writing an active register with a default refresh rate for a current resolution in the plurality of resolutions and for writing CRT timing registers with timing values that generate the default refresh rate;

calling means for calling a video BIOS extension routine to retrieve configuration information from the external CRT, and determining a maximum refresh rate from the configuration information; and second writing means for writing the maximum refresh rate to the active register and for writing the CRT timing registers with timing values that generate the maximum refresh rate when the configuration information is returned, but retaining the default refresh rate in the active register when no configuration information is returned, whereby the external CRT is auto-configured by the configuration information when returned, or the default refresh rate when configuration information is not returned.

17. The computer-program product of claim 16 further comprising:

video mode for setting the current resolution and a current color depth of a pixel.

18. The computer-program product of claim 17 further comprising:

best-fit means for reading a best-fit flag from the system registry file and disabling the calling means and the second writing means when the best-fit flag disables auto-configuration by the computer-program product to enable auto-configuration by the operating system.

* * * * *